US012740606B2

(12) United States Patent
Brothers et al.

(10) Patent No.: US 12,740,606 B2
(45) Date of Patent: Sep. 22, 2026

(54) PROTECTIVE CLOTHING FOR CUTTING OPERATIONS

(71) Applicant: FLEXION GLOBAL LTD, Swaffham (GB)

(72) Inventors: Winston Brothers, Watlington (GB); Karl Brothers, Norfolk (GB); Guy Brothers, Norfolk (GB)

(73) Assignee: FLEXION GLOBAL LIMITED T/A ARBORTEC FORESTWEAR, Swaffham (GB)

( * ) Notice: Subject to any disclaimer, the term of this patent is extended or adjusted under 35 U.S.C. 154(b) by 132 days.

(21) Appl. No.: 17/277,421

(22) PCT Filed: Sep. 19, 2019

(86) PCT No.: PCT/GB2019/000139
§ 371 (c)(1),
(2) Date: Mar. 18, 2021

(87) PCT Pub. No.: WO2020/058662
PCT Pub. Date: Mar. 26, 2020

(65) Prior Publication Data

US 2022/0030964 A1 Feb. 3, 2022

(30) Foreign Application Priority Data

Sep. 19, 2018 (GB) ..... 1815269

(51) Int. Cl.
*A41D 13/05* (2006.01)
*A41D 1/06* (2006.01)
(Continued)

(52) U.S. Cl.
CPC ..... *A41D 13/0543* (2013.01); *A41D 27/04* (2013.01); *A41D 31/245* (2019.02); *A41D 1/06* (2013.01); *A41D 13/043* (2013.01)

(58) Field of Classification Search
CPC ..... A41D 27/04; A41D 13/0543; A41D 1/06
See application file for complete search history.

(56) References Cited

U.S. PATENT DOCUMENTS 5,095,544 A * 3/1992 Elverskog ..... A41D 13/0543 2/2.5
7,832,022 B1 * 11/2010 Peters ..... A41D 1/084 2/227

(Continued)

FOREIGN PATENT DOCUMENTS

DE 202010007048 U1 8/2010
EP 1728442 A1 * 12/2006 ..... A41D 1/06

(Continued)

OTHER PUBLICATIONS

International Search Report for International Application No. PCT/GB2019/000139 mailed Nov. 22, 2019, 5 pages.
English translation of DE 202010007048 U1.

*Primary Examiner* — Katherine M Moran
(74) *Attorney, Agent, or Firm* — Venable LLP; Keith G. Haddaway

(57) ABSTRACT

Protective clothing for cutting operations includes an inner layer having the form of an article of clothing and an outer layer having the form of the same article of clothing as the inner layer and is configured to fit over the inner layer. The material of the inner layer is formed of least partly of a cut-resistant material. The inner and outer layers include a fastener which is configured to retain the inner and outer layers together in use.

20 Claims, 4 Drawing Sheets

(51) Int. Cl.

| | |
|---|---|
| ***A41D 27/04*** | (2006.01) |
| ***A41D 31/24*** | (2019.01) |
| *A41D 13/04* | (2006.01) |

(56) References Cited

U.S. PATENT DOCUMENTS

| | | | | |
|---|---|---|---|---|
| 8,516,615 | B2 * | 8/2013 | Di Giovanni | A41D 31/085 2/81 |
| 11,134,733 | B2 * | 10/2021 | Miller | A41B 9/001 |
| 2002/0073474 | A1 | 6/2002 | Geng | |
| 2005/0278822 | A1 | 12/2005 | Grilliot | |
| 2008/0209611 | A1 * | 9/2008 | Tyrrell | A41D 27/04 2/81 |
| 2010/0050699 | A1 * | 3/2010 | Kolmes | D04B 1/28 66/178 R |
| 2010/0275341 | A1 | 11/2010 | Sweeney et al. | |
| 2012/0260400 | A1 * | 10/2012 | Franz | A41D 27/04 2/236 |
| 2015/0059045 | A1 * | 3/2015 | Supper | D04B 21/16 2/24 |
| 2015/0113700 | A1 | 4/2015 | Carrier | |
| 2015/0275568 | A1 * | 10/2015 | Eng | E05G 1/024 428/221 |
| 2018/0271186 | A1 * | 9/2018 | Milling | A41D 13/0543 |
| 2019/0216148 | A1 * | 7/2019 | Miller | A41D 27/04 |

FOREIGN PATENT DOCUMENTS

| | | | | |
|---|---|---|---|---|
| EP | 1902638 | A2 | 3/2008 | |
| WO | WO-9714323 | A1 * | 4/1997 | A41D 13/0543 |
| WO | WO-2010071937 | A1 * | 7/2010 | A41D 13/05 |

* cited by examiner

PROTECTIVE CLOTHING FOR CUTTING OPERATIONS

FIELD

The present invention relates to protective clothing for cutting operations. More particularly, the present invention relates to protective clothing for use when operating logging and cutting equipment such as chainsaws.

BACKGROUND

Safety guidelines and rules recommend or require the use of safety equipment when operating hazardous machinery. In the logging, forestry, silviculture, arboricuture and agriculture industries, there are a number of generally recommend safety practices that are followed when operating cutting equipment such as chainsaws. Chainsaw users are required to wear protective clothing while operating chainsaws. This equipment can include clothing such as helmets with face shields, safety boots, ear defenders, and trousers that are resistant or proof against chainsaw cuts.

It is difficult to balance the conflicting requirements of creating an item of clothing from or containing material that is proof against high-force cutting/tearing impacts such as those inflicted by a chainsaw chain or blade, and also making the clothing light, flexible and comfortable enough for wear by a user over sustained periods. Clothing that makes the user too hot, or which prevents the user moving easily, is also a safety problem—a worker unable to move easily and/or suffering from being too hot is not safe, even if the clothing is otherwise providing adequate cut resistance. Furthermore, a user may require several different sets of safety gear for use in different circumstances, where different certified standards may apply. This can add considerably to equipment expenses. Also, changes in weather conditions or temperature can make a single set of safety gear impractical for use at different seasons, or in different geographical locations, or even different times of day.

In this specification where reference has been made to patent specifications, other external documents, or other sources of information, this is generally for the purpose of providing a context for discussing the features of the invention. Unless specifically stated otherwise, reference to such external documents is not to be construed as, an admission that such documents, or such sources of information, in any jurisdiction, are prior art, or form part of the common general knowledge in the art.

SUMMARY

It is an object of the present invention to provide protective clothing for cutting operations which goes some way to overcoming the abovementioned disadvantages or which at least provides the public or industry with a useful choice.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

Accordingly, in a first aspect the present invention may broadly be said to consist in protective clothing for cutting operations, comprising: an inner layer having the form of an article of clothing, the material of the inner layer at least partly comprising a cut-resistant material, the inner layer formed to resist cuts; an outer layer, having the form of the same article of clothing as the inner layer, and configured to fit over the inner layer; the inner and outer layers further comprising a least one mutual fastener configured to releasably retain the inner and outer layers together in use. This allows different inner layers to be used with different outer layers, where different levels of protection are required, or where circumstances require different types of outer protection.

In an embodiment, the article of clothing comprises a pair of trousers.

In an embodiment, at least part of the inner layer is configured to provide a visual identifier of the level and/or type of protection provided by the inner layer.

In an embodiment, at least part of the inner layer is colour-coded so as to provide the visual identifier.

In an embodiment, the mutual fastener is configured to at least partly provide the visual identifier for the inner layer, the mutual fastener and outer layer configured so that at least part of the mutual fastener can be viewed in a substantially unobstructed fashion in use.

In an embodiment, the mutual fastener comprises a plurality of buttons on the inner layer, the outer layer comprising corresponding button holes, the outer layer and buttons configured so that the buttons can be viewed in a substantially unobstructed fashion in use.

In an embodiment, the mutual fastener further comprises at least one zip.

In an embodiment, the inner layer further comprises a rear flap, configured to in use extend over the rear edge of the outer layer, the rear flap and outer configured for mutual connection.

In an embodiment, the rear flap comprises at least one button slot, the outer layer comprising at least one corresponding button configured to connect the rear flap to the outer surface of the rear of the outer layer via the button slot, in such a manner that the rear flap can be viewed in a substantially unobstructed fashion in use.

In an embodiment, the protective clothing further comprises hook-and-loop fasteners attached to the inner and outer layers positioned so that when in use the connection acts to help prevent the inner layer sagging under the weight of the cut protective layers.

In an embodiment, the hook-and-loop fasteners are connected at the waistband, at each side.

In an embodiment, the outer layer comprises one or more of: a waterproof material; a high visibility material; an arc and/or flame resistant material; an anti-static material; an insulation-lined outer layer for use in inclement weather; a lightweight fabric for use in hot climates a heavyweight fabric for use in harsh conditions; an eco-friendly fabric; a disposable fabric layer; materials of a specific colour or pattern.

With respect to the above description then, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

This invention may also be said broadly to consist in the parts, elements and features referred to or indicated in the specification of the application, individually or collectively, and any or all combinations of arty two or more said parts, elements or features, and where specific integers are mentioned herein which have known equivalents in the art to which this invention relates, such known equivalents are deemed to be incorporated herein as if individually set forth.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE FIGURES

Further aspects of the invention will become apparent from the following description which is given by way of example only and with reference to the accompanying drawings which show an embodiment of the device by way of example, and in which.

DETAILED DESCRIPTION

Embodiments of the invention, and variations thereof, will now be described in detail, with reference to the figures.

Figure 1C:
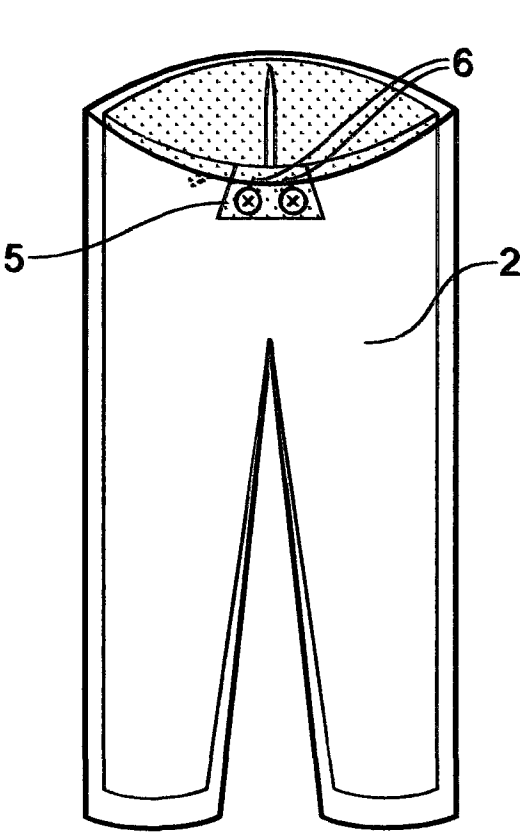
FIGS. 1*a*-1*c* show front, side and rear views of an embodiment of the protective clothing for cutting operations of the present invention, the clothing comprising a pair of trousers, having an outer layer and a removable inner protective layer, the inner layer coloured to show the level of protection provided by the layer, and also to clearly show against the outer layer when a cut has occurred.
Figure 1B:
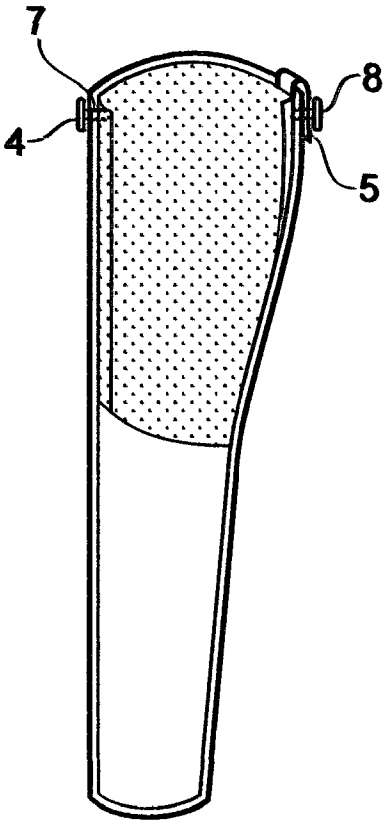
Figure 1A:
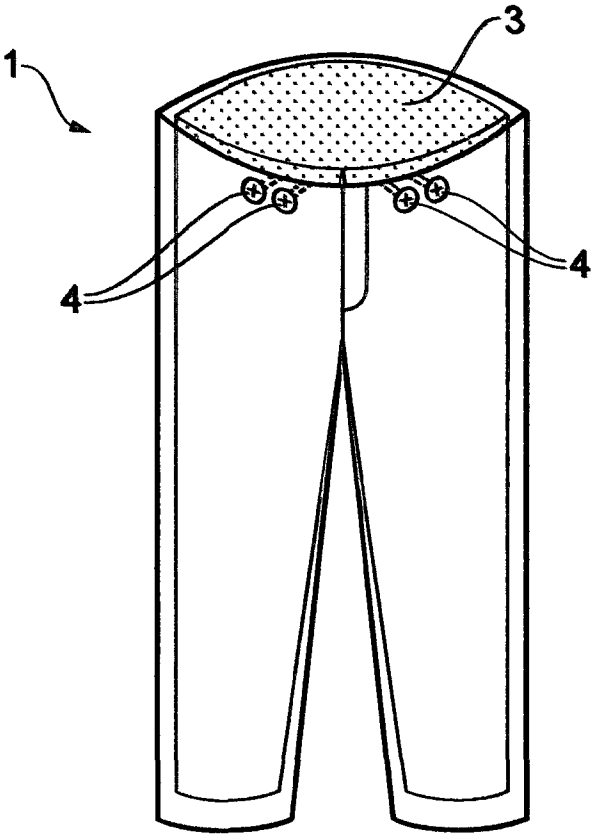

An embodiment of the protective clothing for cutting operations is shown in FIGS. 1*a* to 1*c*. The article of clothing in this embodiment is a pair of trousers 1. The trousers 1 have an outer layer 2, and a removable inner protective layer 3.

Inner Layer

The inner layer 3 in this embodiment forms the main protective layer for the protective clothing. The inner layer 3 is made from breathable open mesh or net 10, connecting to a panel or panels 11 of cut-resistant chainsaw protective knitted fabric. The panels 11 are formed at least partly from knitted fabric which contains lengths of yarn made from high strength fibers, in the manner described below for two possible embodiments.

Figure 2C:
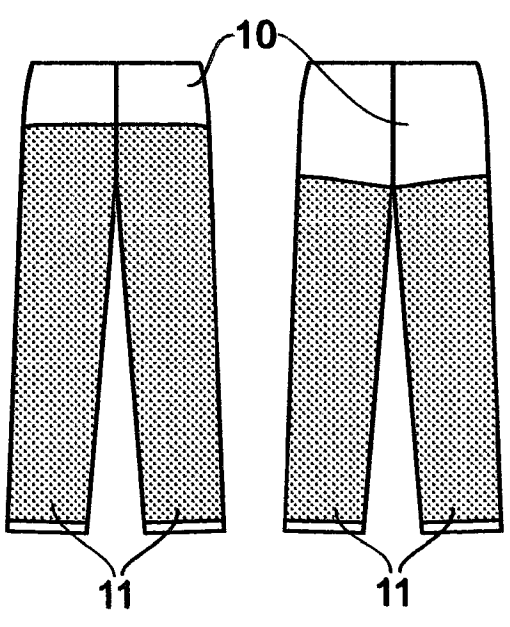
FIGS. 2*a*-2*c* show three different configurations of inner layer, the inner layer formed from a mesh and connected cut-resistant layers, FIG. 2*a* showing a configuration having protective material on the front of the trouser, from ankle to waist band, FIG. 2*b* showing a configuration having protective fabric on the front of the trouser from ankle to waist band and also on the back of the trouser from ankle to half way up the leg, and FIG. 2*c* showing a configuration having protective material on front from ankle to waist band and also on the rear from ankle to crotch.
Figure 2B:
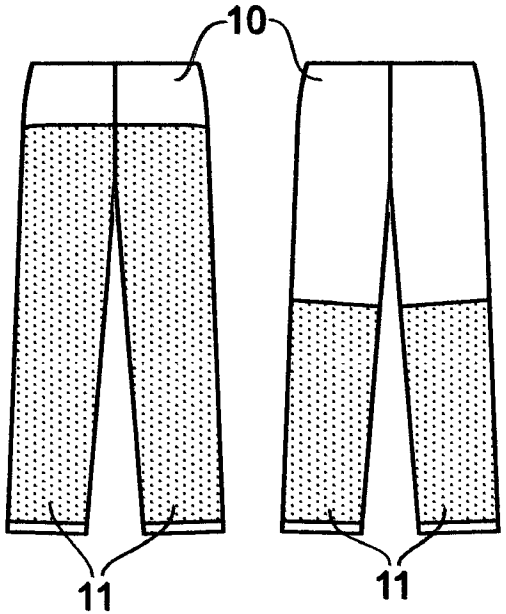
Figure 2A:
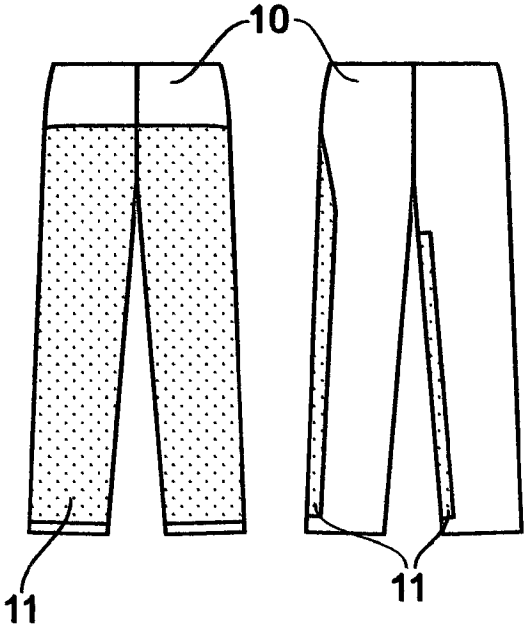
Figure 3:
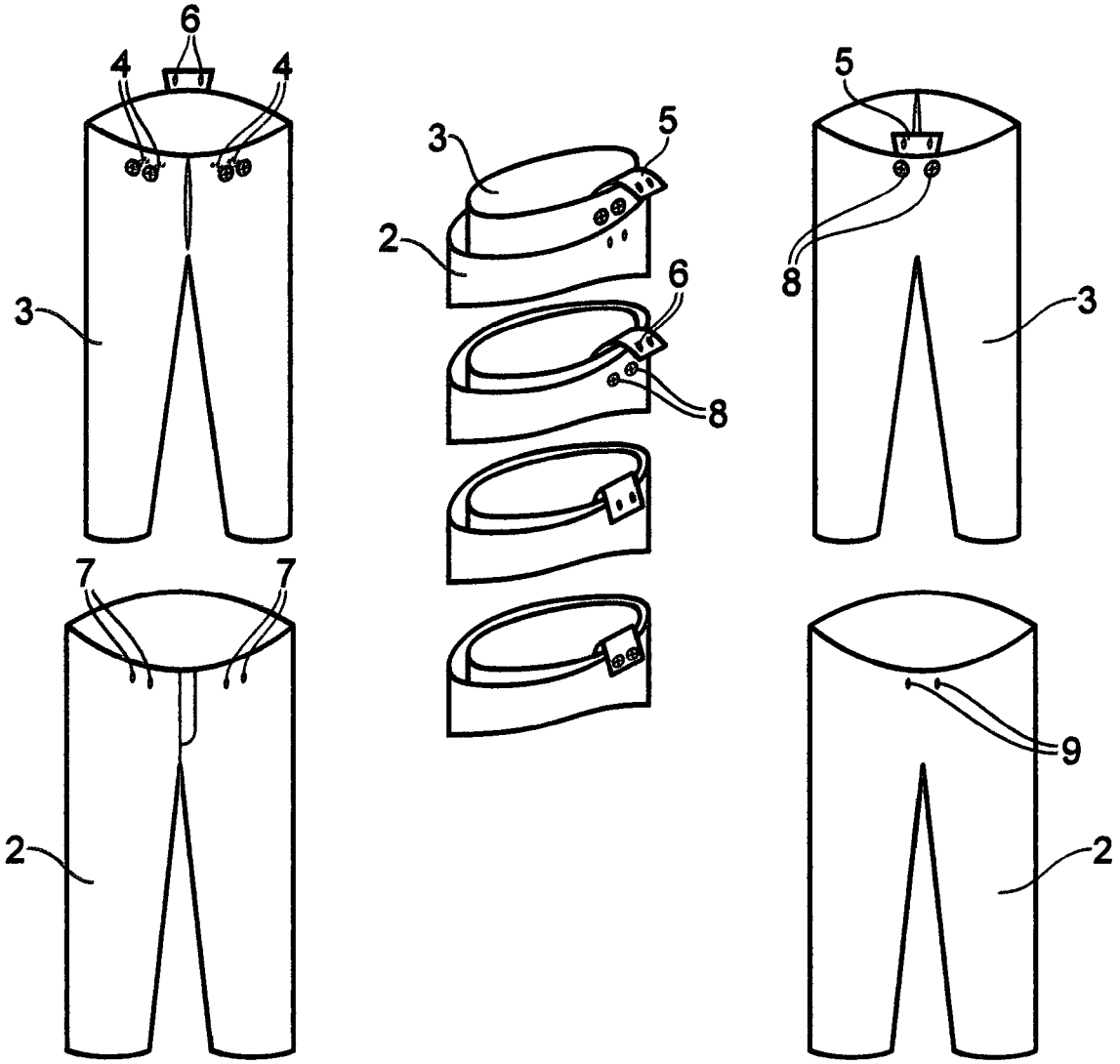
FIG. 3 shows an exploded detail view of the connection between the inner and outer layers.

There are three main different configurations of inner layer (the mesh 10 and the cut-resistant layers 11), as shown in FIGS. 2*a*, 2*b*, and 2*c:*

- Protective material on the front of the trouser, from ankle to waist band (FIG. 2*a*).
- Protective fabric on the front of the trouser from ankle to waist band and also on the back of the trouser, from ankle to half way up the leg (FIG. 2*b*)
- Protective material on front from ankle to waist band and also on the rear from ankle to crotch (FIG. 2*c*).

Other configurations are also possible.

In all three configurations there are areas where there is no protection (e.g. the rear seat region). To preserve privacy when changing the outer layer in public a privacy panel of closer mesh (not see through, but still breathable) is incorporated in the design.

The chainsaw protective layers are attached together by lower strength carrier fibers in such a way that a cut by a chainsaw will pass through the outer layer, and on contacting the inner layer, will pull the high strength fibers loose from the inner layer and into the moving parts of the chainsaw to block and therefore jam/stop the blade. The high strength fibres of the inner layer will be pulled through the cut in the outer layer and into the chain of the chainsaw, or a similar tool.

Figure 4:
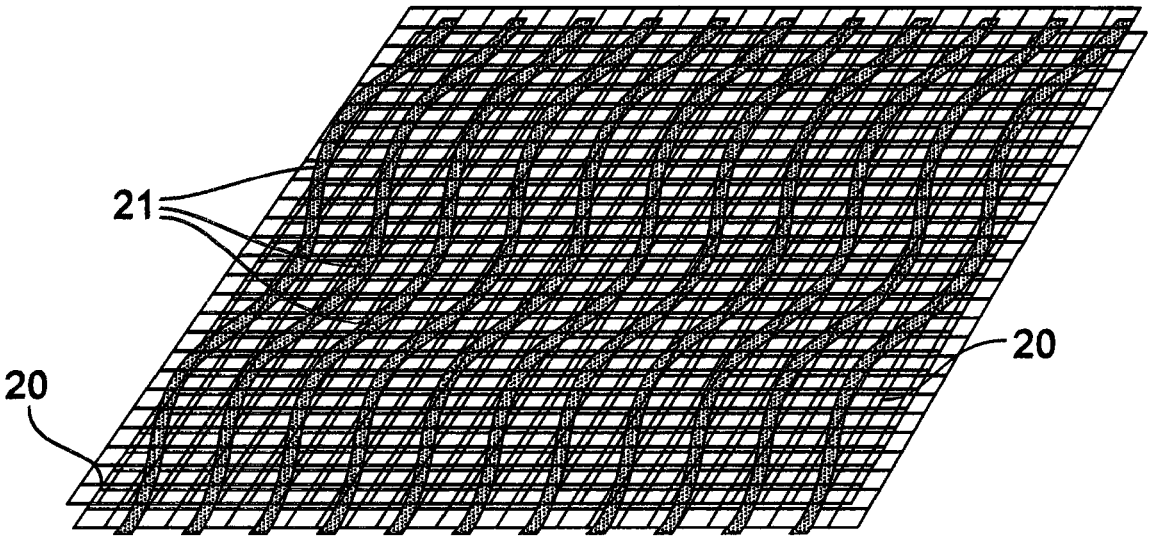
FIG. 4 shows a detail view of the structure of the cut-resistant layers, these formed from a framework of lower strength carrier fibers interwoven with high strength fibers that are held in place by the carrier fibers, the long high strength fibers arranged in a slight wave pattern to enable the fabric to stretch.

While this is the preferred embodiment, variations are possible, such as for example a fabric where the lower strength carrier fibers are knitted in such a way as to provide a secure framework to hold the long high strength fibers in place. This framework of carrier fibers is particularly useful, as it is resilient to being pulled and stretched multiple times without undue deformation. As the inner layer is designed to be handled a lot more than a traditional chainsaw trouser (i.e. while changing the outer layer), this can be important. This also produces a fabric that is very resilient to laundering by machine. One issue with chainsaw trousers of the known type is that these are not washed as often as they should be. An advantage of being able to change the inner layer more easily is that this can be washed more easily, and is therefore more likely to be washed more frequently. In a variation, the long high strength yarns are arranged in, a slight wave pattern to enable the fabric to stretch, as shown in FIG. 4.

Two specific types of construction pattern that can be used to form the panels 11 will now be described. These can be used separately, or in combination (i.e. a single material that includes both patterns—a single protective inner trouser or inner layer 3—can contain layers of one or both of the "Mesh Type" and "Warp Knit Type" described below:

The "Mesh Type" pattern comprises a three-dimensional mesh structure of fine carrier fibres or threads 20 (formed from polyester), into which are incorporated high strength polyester fibres 21, arranged longitudinally with a slight "S" formation.

In the event of a chainsaw cut, the mesh of carrier fibres is cut, which releases the high strength fibers from the woven structure. The high-strength fibres are caught by the chainsaw chain and pulled into the chainsaw sprocket where they will jam, the saw, and therefore stop the blade.

The structure of the mesh, and the S-formation has the advantage of allowing the fabric to stretch. An example of this type of pattern or construction is shown in FIG. 4.

Using polyester material allows the material to easily be coloured by dying or similar. It is also possible to use recycled material.

The "Warp Knit type" pattern comprises a warp-knitted fabric in which a grid of high strength fibers are held in place by low strength carrier fibers. In the event of a chainsaw cut, the carrier fibers release the high strength fibers, which are caught by the chainsaw chain, and pulled into the chainsaw sprocket where the proceed to jam the saw, and therefore stop the blade.

Warp Knit type is normally made form a combination of Polyester, Polyethylene (including Dyneema), and/or Polypropylene. The Warp Knit pattern is not stretchable.

Examples of types of fabrics suitable for use in making the inner layer are produced for example under the brand name 'Avertic'.

This material and construction has the advantage of being breathable and lightweight, so as to minimise heat and movement problems for a wearer.

The inner layer 3 is coloured, depending on the level of protection that it is certified for. For example, the highest level of protection could be coloured green, and the lowest red, with intervening levels coloured appropriately, such as for example orange. It is preferred that the colours used are bright and easily visible—for example florescent orange. This has an advantage if a cut occurs, as it is easy to see the fibres that have been pulled out, and which are entangled in the moving parts of a chainsaw or similar tool.

A set of front fastening buttons 4 extend from the top front of the inner layer 3, one pair of fastening buttons 4 to each side of the centre line. The inner layer 3 further comprises a set of rear fastening buttons 8, on the rear of the inner layer 3, in a corresponding position to rear button slots 9 on the outer layer (see below), at the centre-rear of the inner layer. A fastening flap 5 extends from the top-rear of the inner layer 3. The fastening flap 5 has slots 6 for buttons towards it's top edge. The fastening buttons 4, 8 and the fastening flap 5 are the same colour as the material used for the inner layer 3. The buttons allow the inner layer 3 to be connected to the outer layer 2 in use. In the preferred embodiment, hook-and-loop fastening strips are attached to the outside of the waistband, one at each side. These strips grip corresponding pieces on the outer layer when in use, to prevent the inner layer sagging under the weight of the cut protective layers, and causing discomfort or loss of performance.

The connection is described in detail below.

Outer Layer

The outer layer 2 is intended to be a changeable outer layer, that can come in a variety of different forms or with different functionality—there are different types of outer layer, which can be used depending on the individual scenario or situation. Some examples are outlined below:

- The outer layer can be partly or wholly formed from a waterproof material.
- The outer layer can include a high-visibility material with reflective parts/patches for safety in low light conditions.
- The outer layer can be partly or wholly formed from a very lightweight fabric, for use in hot climates.
- The outer layer can be partly or wholly formed from a flame-resistant fabric.
- The outer layer can be partly or wholly formed from a highly insulating fabric for cold climates.
- The outer layer can be partly or wholly formed from an arc-resistant fabric.
- The outer layer can be partly or wholly formed from an anti-static fabric.
- The outer layer can be partly or wholly formed from a very heavyweight fabric for use in harsh conditions
- The outer layer can be partly or wholly formed from an eco-friendly fabric (i.e. made from recycled or recyclable materials)
- The outer layer can be disposable, for use in areas where there is risk of contamination
- The outer layer can be partly or wholly formed from materials of a specific colour or pattern for uniform (i.e for use by military, law-enforcement or emergency services, or for corporate use).

A set of front button loops or apertures 7 are formed in the front of the outer layer 2, towards the top edge, in a corresponding position to the fastening buttons 4 of the inner layer 3. A set of rear button apertures 9 are formed in the rear of the outer layer 2, towards the top edge, substantially directly behind the rear buttons 8. Two pieces of hook-and-loop material are attached to the inside of the waistband, one at each side of the trouser. These pieces of material correspond to the pieces on the inner layer described above, so that when in use these connect to prevent the inner layer sagging under the weight of the cut protective layers, and causing discomfort or loss of performance.

The inner and outer layers 2, 3 are sized and formed so that the inner layer 3 fits snugly within the outer layer 2, and so that when connected, the inner layer 3 and the outer layer 2 form a single unit or item of clothing that can be worn comfortably for extended periods without the need for adjustment or repositioning of the layers.

The outer layer 2 is formed so that it can be patterned or coloured as required. For example, logos or similar can be printed or embroidered onto the material, or visually distinctive or attractive patterns can be printed or embroidered onto the material. However, it is preferred that the main or overall colour of the outer layer 2 is kept distinct or different from the colour of the inner layer 3, for reasons described below.

The buttons as described above can also be used for attaching suspenders or braces to the trousers.

Connection

In use, the outer layer 2 and the inner layer 3 are connected as follows: the front buttons 4 on the front of the inner layer 3 are passed through the button slots 7 to fasten the front of the inner layer 3 to the outer layer 2. The rear buttons 8 on the rear of the outer layer 2 are passed through the rear button apertures 9, and the flap is then folded over the top of the upper-rear edge of the outer layer 2, with the rear buttons 8 then passed through the flap slots 6 to fasten the rear of the inner layer 3 to the outer layer 2. The hook-and-loop tape strips/pieces on the inner and outer layers connect as outlined above.

It should be noted that zips, hook-and-loop material, press stud/snap fasteners, or any other suitable fasteners could be used in place of and/or as well as the buttons described.

Use

In use, a user chooses the level of protection as appropriate for the task in hand. A user can easily assess which, inner layer to use for a particular job by colour—these can be picked from a store or similar quickly and easily. The appropriate inner layer can be matched with an outer layer appropriate for the job in hand—for example a waterproof layer; a high visibility layer; an arc and/or flame resistant layer; a layer with anti-static properties; an insulation-lined outer layer for use in inclement weather, or a layer which has two or more of these properties. The appropriate outer layer for a particular task can be mixed with and attached to an inner layer that provides the required level of protection for a particular task. The colour of the front buttons 4 and the flap 5 can easily be seen 'at a glance' as these are visible on top of and against the colour of the outer layer. This allows a supervisor or similar to easily and quickly assess the level of protection being worn by a worker—for example green (light), orange (medium), or red (heavy). The distinctive colour of the inner layer 2 allows this to be seen easily through any gash or cut in the outer layer, allowing a user to easily assess whether a chainsaw or other cutting instrument has hit or damaged the trousers.

If the outer layer needs changing—for example to replace a lightweight dry-use layer for a waterproof layer if the weather becomes wet, this can be achieved quickly and easily by releasing the buttons at the front and rear, and pulling apart the hook and loop material patches, and slipping off and replacing the outer layer on top of the inner layer, which will remain in position, worn by a user. A user can also change these on-site, without needing to fully strip their lower layer, with the privacy and discretion issues that this might entail.

A user or organisation using this system is not required to purchase multiple different items of clothing in order to fulfil a range of roles—they can mix and match inner and outer layers as required to create the right combination. For example, a user requiring waterproof and non-waterproof versions of light, medium, and heavy duty protective trousers would previously have been required to purchase six items: light waterproof, light non-waterproof, medium waterproof, medium non-waterproof, heavy waterproof, and heavy non-waterproof. In contrast, they can now purchase a lightweight, medium and heavyweight inner layer, and two outer layers—dry use and waterproof. It is also easy to purchase 'spare' outer layers, as these do not require certification in the same manner as the protective inner layer, and are much less expensive.

If one layer becomes damaged (for example if the outer layer is ripped or stained, but the inner layer is undamaged), this can be easily replaced at a lower cost than having to replace a single integrated unit or pair of protective trousers.

A protective garment such as that described above also helps to provide a range of gear for the market. For integrated items (without a separate inner and outer layer), each item needs to be certified for use as protective gear, to show that it achieves at least a minimum standard, so it is expensive and time-consuming to produce a wide range of different styles. In contrast, for the present invention, once the inner layers are certified, outer layers in a range of styles can be produced and used with the inner layers, allowing a wide range of styles to be used for less cost than if the same range was produced for integrated items.

The invention claimed is:

1. Protective clothing for chainsaw cutting operations, comprising:

an inner layer having the form of an article of clothing, the inner layer comprising a breathable open mesh or net having one or more panels connected thereto, the one or more panels comprising a cut-resistant material formed from a framework of carrier fibers interwoven with high strength fibers held in place by the carrier fibers, the carrier fibers being of lower strength than the high strength fibers, the cut-resistant fibers arranged in a wave pattern; the carrier fibers and the high strength fibers attached to one another so that a cut by a chainsaw pulls the high strength fibers loose from the carrier fibers into a chainsaw sprocket of the chainsaw, the cut-resistant material being on a front of the inner layer and the inner layer having a first visually distinctive property comprising a color which indicates a level and/or type of protection provided by the inner layer;

a changeable outer layer having a second visually distinctive property which is visually different from the first visually distinctive property, the outer layer configured to fit over the inner layer, the outer layer concealing the cut-resistant material prior to the cut occurring;

wherein the inner layer comprises areas where there is no panel.

2. The protective clothing as claimed in claim 1, wherein the article of clothing comprises trousers.

3. The protective clothing as claimed in claim 1, the inner layer and the outer layer each further comprising at least one mutual fastener configured to releasably retain the inner and outer layers together in use, wherein the at least one mutual fastener is colored and has the same color as the inner layer, the at least one mutual fastener and the outer layer are configured so that at least part of the at least one mutual fastener can be viewed in a substantially unobstructed fashion in use.

4. The protective clothing as claimed in claim 3, wherein the at least one mutual fastener comprises a plurality of buttons on the inner layer and corresponding button holes on the outer layer, the outer layer and button holes being configured so that the buttons can be viewed in use.

5. The protective clothing as claimed in claim 3, wherein the at least one mutual fastener comprises at least one zipper.

6. The protective clothing as claimed in claim 3, wherein the inner layer comprises a rear flap as the at least one mutual fastener, the one rear flap configured to extend over a rear edge of the outer layer, the rear flap and the outer layer being configured for mutual connection.

7. The protective clothing as claimed in claim 6, wherein the rear flap comprises at least one button slot, the outer layer comprising at least one corresponding button configured to connect the rear flap to an outer surface of a rear of the outer layer via the button slot, in such a manner that the rear flap can be viewed in use.

8. The protective clothing as claimed in claim 1, further comprising hook-and-loop fasteners attached to the inner and outer layers and positioned so that, when connected, the hook and-loop fasteners on the inner and outer layers prevent the inner layer from sagging.

9. The protective clothing as claimed in claim 8, wherein the article of clothing is trousers and the hook-and-loop fasteners are connected at each side of a waistband of the trousers.

10. The protective clothing as claimed in claim 1, wherein the outer layer comprises one or more of: a waterproof material, a high visibility material, an arc and/or flame resistant material, an anti-static material, an insulation-lined outer layer for use in inclement weather, a lightweight fabric for use in hot climates, an eco-friendly fabric, a disposable fabric layer, and materials of a specific color or pattern.

11. The protective clothing as claimed in claim 1, wherein at least one of the one or more panels is provided on at least part of a rear of the inner layer.

12. The protective clothing according to claim 1, wherein:

the at least one panel comprises the high strength fibers interwoven longitudinally within a three-dimensional mesh structure of the carrier fibers.

13. Protective clothing for cutting operations, comprising:

an inner layer having the form of an article of clothing and comprising a breathable open mesh or net having one or more panels connected thereto, the one or more panels comprising a cut-resistant material formed from a framework of carrier fibers interwoven with high strength fibers held in place by the carrier fibers, the carrier fibers being of lower strength than the high strength fibers, the high strength fibers arranged in a wave pattern; carrier fibers and the high strength fibers attached to one another so that a cut by a chainsaw pulls the high strength fibers loose from the carrier fibers into a chainsaw sprocket of the chainsaw, at least one panel of the one or more panels comprising the cut-resistant material is positioned on a front of the inner layer;

the cut-resistant material having a first visually distinctive property which indicates a level and/or type of protection provided by the inner layer, and the inner layer comprising a portion which does not have a panel connected thereto; and a changeable outer layer having a second visually distinctive property which is visually different from the first visually distinctive property, the outer layer having the form of the same article of clothing as the inner layer and configured to fit over the inner layer, the outer layer concealing the inner layer when worn by a wearer prior to the cut occurring, wherein the cut-resistant material is easily visible and will clearly show against the outer layer after the cut has occurred; and at least one mutual fastener configured to releasably retain the inner and outer layers together in use.

14. The protective clothing as claimed in claim 13, wherein the cut-resistant material and the at least one mutual fastener are colored the same color, the at least one mutual fastener and the outer layer are configured so that at least part of the at least one mutual fastener can be viewed in a substantially unobstructed fashion in use.

15. The protective clothing as claimed in claim 13, wherein the at least one mutual fastener is selected from:

A. at least one zipper,

B. a plurality of buttons on the inner layer and corresponding button holes on the outer layer, the outer layer and button holes being configured so that the buttons can be viewed in a substantially unobstructed fashion in use, and C. a rear flap configured to in use extend over a rear edge of the outer layer, the rear flap and the outer layer configured for mutual connection, the rear flap comprising at least one button slot, the outer layer comprising at least one corresponding button configured to connect the rear flap to an outer surface of a rear of the outer layer via the button slot, in such a manner that the rear flap can be viewed in a substantially unobstructed fashion in use.

16. The protective clothing as claimed in claim 13, further comprising hook-and-loop fasteners attached to the inner and outer layers positioned so that when the hook-and-loop fasteners on the inner and outer layers are connected to form a connection that acts to help prevent the inner layer from sagging.

17. The protective clothing as claimed in claim 13, wherein the outer layer comprises one or more of: a waterproof material, a high visibility material, an arc and/or flame resistant material, an anti-static material, an insulation-lined outer layer for use in inclement weather, a lightweight fabric for use in hot climates, an eco-friendly fabric, a disposable fabric layer, and materials of a specific color or pattern.

18. The protective clothing as claimed in claim 13, wherein at least one panel of the one or more panels provided on at least part of a rear of the inner layer.

19. The protective clothing as claimed in claim 18, wherein the article of clothing is trousers and the inner layer further comprising a privacy panel of closer breathable mesh than the breathable mesh of the inner layer on a seat of the trousers.

20. The protective clothing as claimed in claim 13, wherein a portion further comprising a privacy panel of closer breathable mesh than the breathable mesh of the inner layer.

* * * * *